US011193494B2

(12) United States Patent
Cho et al.

(10) Patent No.: US 11,193,494 B2
(45) Date of Patent: Dec. 7, 2021

(54) COMPRESSOR WHEEL FOR TURBOCHARGER

(71) Applicants: Hyundai Motor Company, Seoul (KR); Kia Motors Corporation, Seoul (KR); Korea Advanced Institute of Science and Technology, Daejeon (KR)

(72) Inventors: Teock Hyeong Cho, Seoul (KR); Gue Hyun Jung, Gyeonggi-do (KR); Yong Cheol Lee, Gyeonggi-do (KR); Young Sik Kim, Seoul (KR); Dal Heun Shin, Seoul (KR); O Jun Kwon, Gyeonggi-do (KR); Duck Joo Lee, Daejeon (KR); Dong Ho Seo, Daejeon (KR)

(73) Assignees: Hyundai Motor Company, Seoul (KR); Kia Motors Corporation, Seoul (KR); Korea Advanced Institute of Science and Technology, Daejeon (KR)

( * ) Notice: Subject to any disclaimer, the term of this patent is extended or adjusted under 35 U.S.C. 154(b) by 96 days.

(21) Appl. No.: 16/693,251

(22) Filed: Nov. 23, 2019

(65) Prior Publication Data

US 2020/0340491 A1 Oct. 29, 2020

(30) Foreign Application Priority Data

Apr. 23, 2019 (KR) ..... 10-2019-0047574

(51) Int. Cl.

*F04D 29/24* (2006.01)
*F04D 29/30* (2006.01)
*F04D 29/28* (2006.01)
*F04D 29/66* (2006.01)

(52) U.S. Cl.

CPC ..... *F04D 29/242* (2013.01); *F04D 29/284* (2013.01); *F04D 29/30* (2013.01); *F04D 29/667* (2013.01)

(58) Field of Classification Search

CPC ..... F04D 29/667; F04D 29/284; F04D 29/30; F04D 29/242; F05D 2220/40

See application file for complete search history.

(56) References Cited

U.S. PATENT DOCUMENTS 6,629,556 B2 * 10/2003 Decker ..... B22C 7/02 164/35
9,494,160 B2 * 11/2016 Tomita ..... F04D 29/284
2011/0091323 A1 * 4/2011 Koike ..... F04D 29/4213 416/175

FOREIGN PATENT DOCUMENTS

KR 10-2019-0022988 A 3/2019

* cited by examiner

*Primary Examiner* — David E Sosnowski
*Assistant Examiner* — Sabbir Hasan
(74) *Attorney, Agent, or Firm* — Mintz Levin Cohn Ferris Glovsky and Popeo, P.C.; Peter F. Corless

(57) ABSTRACT

A compression wheel for a turbocharger includes: a wheel hub; and a plurality of blades that are arranged around the wheel hub in a spiral shape, where a round portion is provided at a tip of a leading edge of each of the blades.

5 Claims, 9 Drawing Sheets

FIG. 4

| | R | $\frac{\text{round projected area}}{\text{inlet projected area}} \times 100(\%)$ | inlet noise | outlet noise | efficiency (%) |
|---|---|---|---|---|---|
| Case1 | 21.5mm | 5% | 1.2dBA reduction | 3.2dBA reduction | 0% |
| Case2 | 21.5mm | 10% | 1.9dBA reduction | 4.1dBA reduction | 0% |
| Case3 | 21.5mm | 15% | 2.3dBA reduction | 4.4dBA reduction | +1% |
| Case4 | 21.5mm | 20% | 2.5dBA reduction | 5.0dBA reduction | +1% |
| Case5 | 21.5mm | 25% | 3.0dBA reduction | 5.7dBA reduction | −1% |
| Case6 | 21.5mm | 30% | 3.6dBA reduction | 6.3dBA reduction | −1.5% |

COMPRESSOR WHEEL FOR TURBOCHARGER

CROSS REFERENCE TO RELATED APPLICATION

The present application claims under 35 U.S.C. § 119(a) the benefit of Korean Patent Application No. 10-2019-0047574, filed Apr. 23, 2019, the entire contents of which are incorporated by reference herein.

BACKGROUND

(a) Technical Field

The present disclosure relates generally to a turbocharger used in internal combustion engines, more particularly, to a compressor wheel for the turbocharger.

(b) Description of the Related Art

Generally, a turbocharger rotates a turbine using energy of exhaust gas that is discharged from an internal combustion engine, so that the turbine rotates a compressor wheel, whereby air can be compressed and supplied to a combustor.

The compressor wheel tends to generate a broadband frequency noise due to irregular turbulence of air while rotating at a high speed by the turbine.

The foregoing is intended merely to aid in the understanding of the background of the present disclosure, and is not intended to mean that the present disclosure falls within the purview of the related art that is already known to those skilled in the art.

SUMMARY

Accordingly, the present disclosure proposes a compressor wheel for a turbocharger, wherein the compressor wheel is configured to reduce noise caused by irregular turbulence of air as the compressor wheel is rotated at a high speed, and ultimately allows quieter driving by improving noise characteristics of a vehicle.

In order to achieve the above object, according to one aspect of the present disclosure, there is provided a compressor wheel for a turbocharger including: a wheel hub; and a plurality of blades provided around the wheel hub in a spiral shape, wherein a round portion is provided at a tip (i.e., a leading edge tip) of a leading edge of each of the blades.

The round portion may be configured such that a round projected area that is an area of a round projected length sweeping away on a projection plane by one rotation is within a range of about 15% to 20% of an effective inlet area that is an area of the leading edge of the blade sweeping away on the projection plane by one rotation, the round projected length being a radial length of the compressor wheel that is obtained by projecting the round portion on the projection plane perpendicular to a rotation shaft of the compressor wheel.

The round projected length may be determined by the following equation.

$$\sqrt{R^2-0.15(R^2-R_H^2)} \le \overline{R} \le \sqrt{R^2-0.2(R^2-R_H^2)}$$

$\overline{R}$: round projected length

R: maximum radius at inlet side of compressor wheel $R_H$: radius of wheel hub

The leading edge of the blade may be cut within 30% of overall length of the leading edge from the leading edge tip and within a predetermined reference length.

The reference length may be about 0.2 mm.

When a plurality of blades is arranged such that relatively large main blades and relatively small sub blades are alternately arranged around the wheel hub, the round portion may be provided only in a leading edge tip of each of the main blades.

According to the present disclosure, the compressor wheel of the turbocharger is configured to reduce noise caused by irregular turbulence of air as the compressor wheel is rotated at a high speed. Therefore, noise characteristics of the vehicle are ultimately improved, and thus quieter driving can be realized.

BRIEF DESCRIPTION OF THE DRAWINGS

The above and other objects, features and other advantages of the present disclosure will be more clearly understood from the following detailed description when taken in conjunction with the accompanying drawings, in which:

FIG. 4 is a table of comparing noises and efficiencies of the compressor wheel according to the present disclosure, depending on change of a round projected area with respect to an inlet projected area.

DETAILED DESCRIPTION OF THE DISCLOSURE

Figure 1:
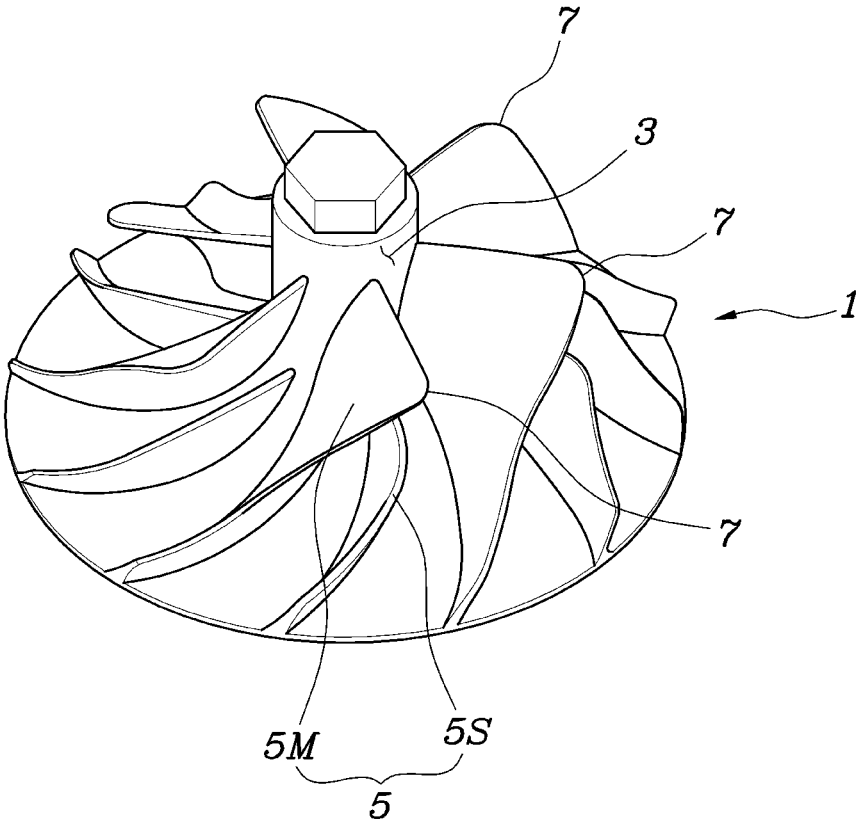
FIG. 1 is a perspective view of a compressor wheel for a turbocharger according to the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinbelow, exemplary embodiments of the present disclosure will be described in detail with reference to the accompanying drawings. Throughout the drawings, the same reference numerals will refer to the same or like parts.

Figure 2:
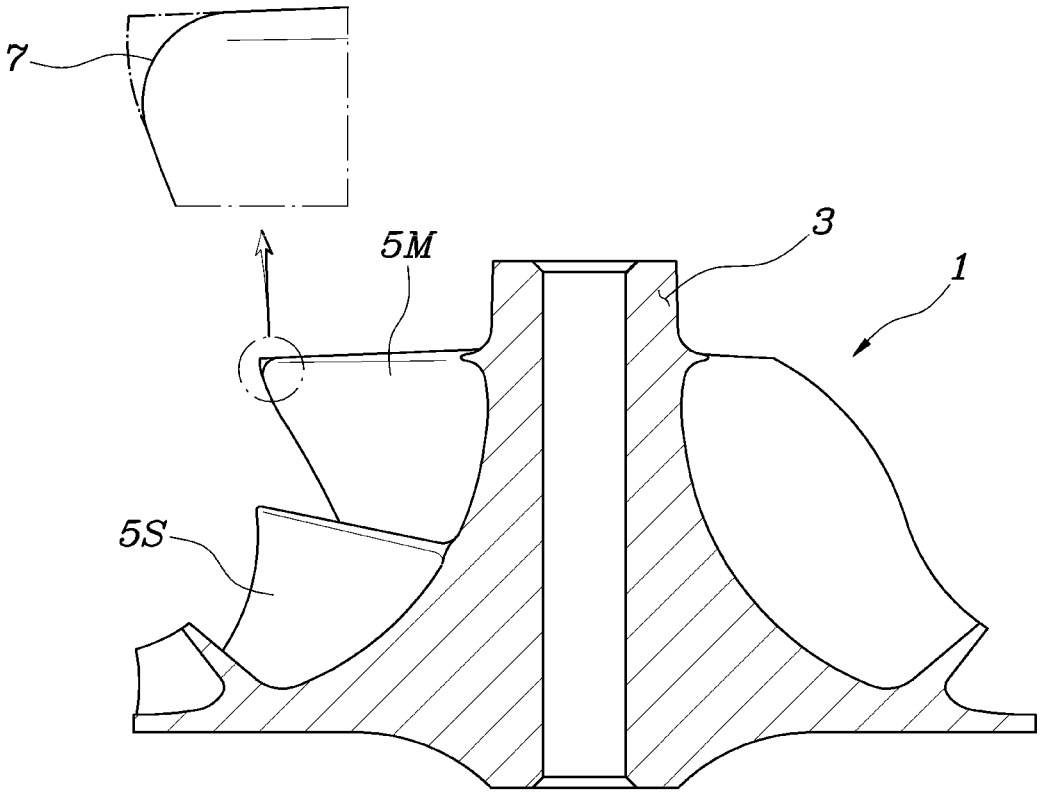
FIG. 2 is a vertical-sectional view showing a round portion of the compressor wheel according to the present disclosure in detail.
Figure 3:
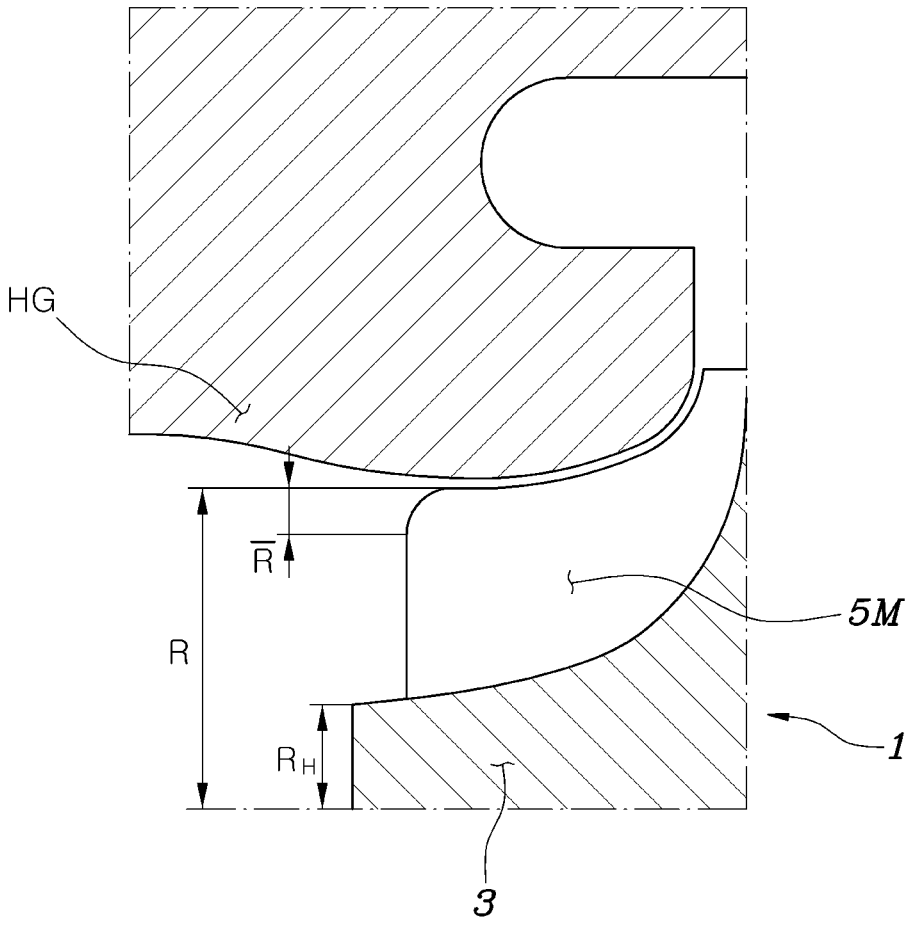
FIG. 3 is a partial-sectional view showing the compressor wheel that is mounted in a turbocharger housing.

Referring to FIGS. 1 to 3, according to an embodiment of the present disclosure, a compressor wheel 1 of a turbocharger includes a wheel hub 3 and a plurality of blades 5 that are provided around the wheel hub 3 in a spiral shape. In particular, a round portion 7 is provided at a tip (i.e., a leading edge tip) of a leading edge of each of the blades 5.

That is, in the present disclosure, the leading edge tip of the compressor wheel is formed in the round portion 7, rather than being conventionally formed as a sharp edge. Thus, when the compressor wheel 1 is rotated at a high speed, irregular turbulence of air is reduced, and operation noise of the turbocharger can be reduced.

For reference, when the plurality of blades 5 is arranged such that relatively large main blades 5M and relatively small sub blades 5S are alternately arranged around the wheel hub 3, the round portion 7 may be provided only at a leading edge tip of each of the main blades 5M.

The round portion 7 is preferably formed such that a round projected area that is an area of a round projected length sweeping away on a projection plane by one rotation is within a range of about 15% to 20% of an effective inlet area that is an area of the leading edge of the blade sweeping away on the projection plane by one rotation. The round projected length mentioned above is a radial length of the compressor wheel that is obtained by projecting the round portion 7 on the projection plane perpendicular to a rotation shaft of the compressor wheel.

That is, referring to FIG. 3 that is a partial-sectional view showing the compressor wheel 1 mounted in a turbocharger housing HG, the round projected length is determined by the following Equation 1.

$$\sqrt{R^2-0.15(R^2-R_H^2)} \le \overline{R} \le \sqrt{R^2-0.2(R^2-R_H^2)} \qquad \text{[EQUATION 1]}$$

$\overline{R}$: round projected length

R: maximum radius at inlet side of compressor wheel $R_H$: radius of wheel hub

That is, the round projected area with respect to the effective inlet area is preferably within a range of about 15% to 20%, because the ratio is preferable in consideration of the noise reduction effect and the compressor efficiency, as shown in FIGS. 4 to 8.

FIG. 4 is a table of comparing noises and efficiencies, depending on change of the round projected area with respect to an inlet projected area. In all six examples, the maximum radius R at an inlet side of the compressor wheel is 21.5 mm, the round projected area $\pi[R^2-(R-\overline{R})^2]$ with respect to the inlet projected area $\pi R^2$ calculated by the maximum radius R varies within a range of 5%~30%, and then comparisons for internal noises at a compressor inlet, internal noises at a compressor outlet, and turbocharger efficiencies are performed. As shown in FIG. 4, when the round projected area with respect to the inlet projected area is within a range of about 15% to 20%, the noise reduction effect and the turbocharger efficiency reach desired results.

Figure 5:
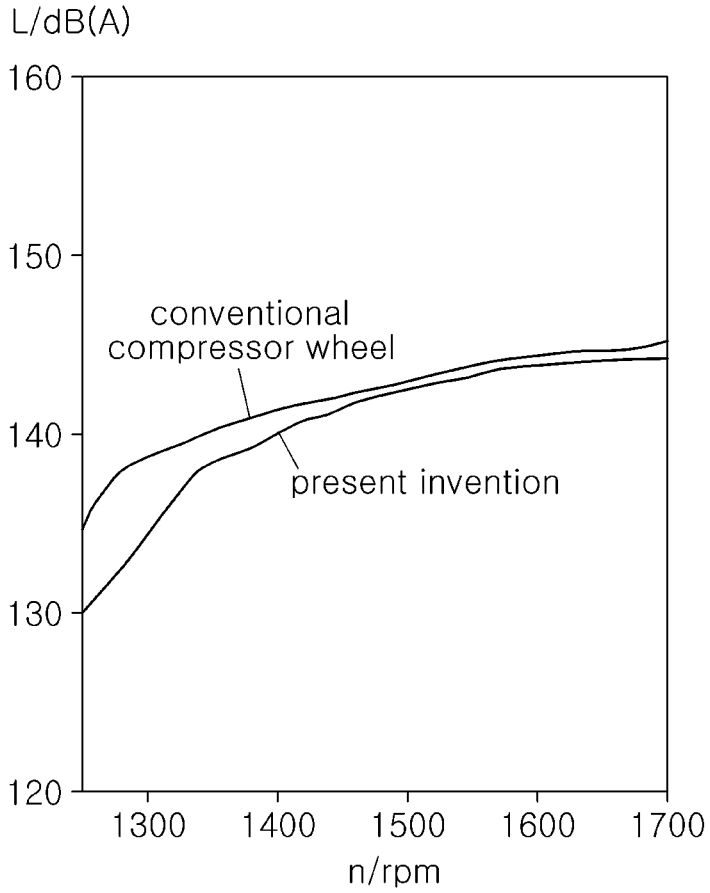
FIG. 5 is a graph of comparing noise reduction effects of a turbocharger using the compressor wheel of the present disclosure and a turbocharger using a conventional compressor wheel, and a graph of comparing internal noises at a compressor inlet depending on the number of compressor wheel rotations.

For reference, FIG. 5 is a graph of comparing noise reduction effects of a turbocharger using the compressor wheel of the present disclosure and a turbocharger using the conventional compressor wheel, and a graph of comparing internal noises at the compressor inlet depending on the number of compressor wheel rotations. In particular, the present disclosure adopts a compressor wheel in which the round projected area with respect to the inlet projected area is 20%.

In FIG. 5, the conventional turbocharger that is a comparison target is a turbocharger that uses a compressor wheel in which an inlet projected area of the compressor wheel is the same as the present disclosure, but a round projected area is approximately zero % because a blade of the compressor wheel is without the round portion of the present disclosure.

Figure 6:
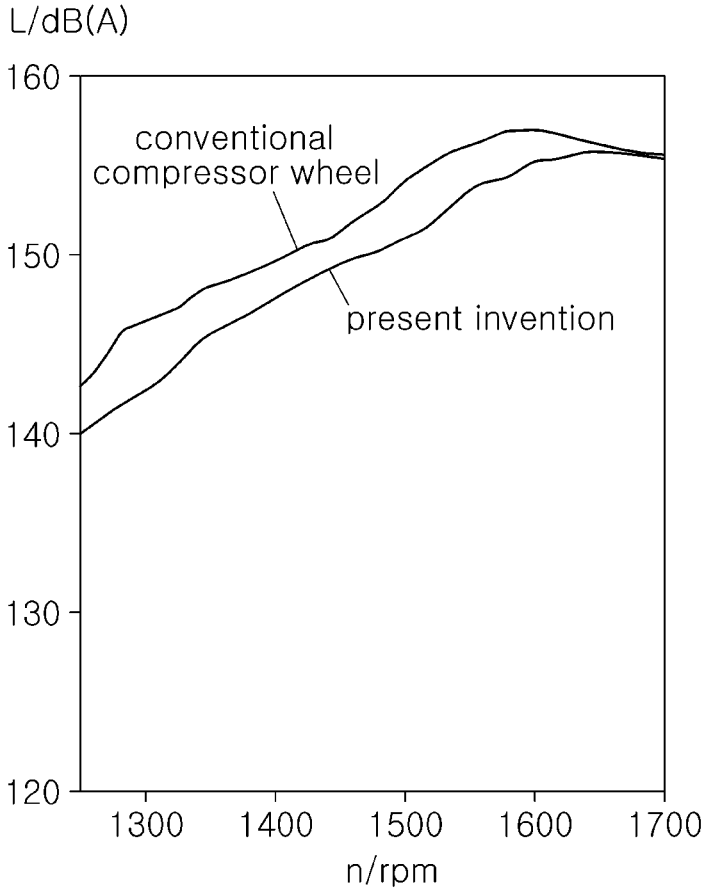
FIG. 6 is a graph of comparing reduction effects of the turbocharger using the compressor wheel of the present disclosure and the turbocharger using the conventional compressor wheel, and a graph of comparing internal noises at a compressor outlet depending on the number of the compressor wheel rotations.

In addition, FIG. 6 is a graph of comparing internal noises at a compressor outlet depending on the number of the compressor wheel rotations. In particular, the present disclosure adopts the compressor wheel in which the round projected area with respect to the inlet projected area is 20%.

Figure 7:
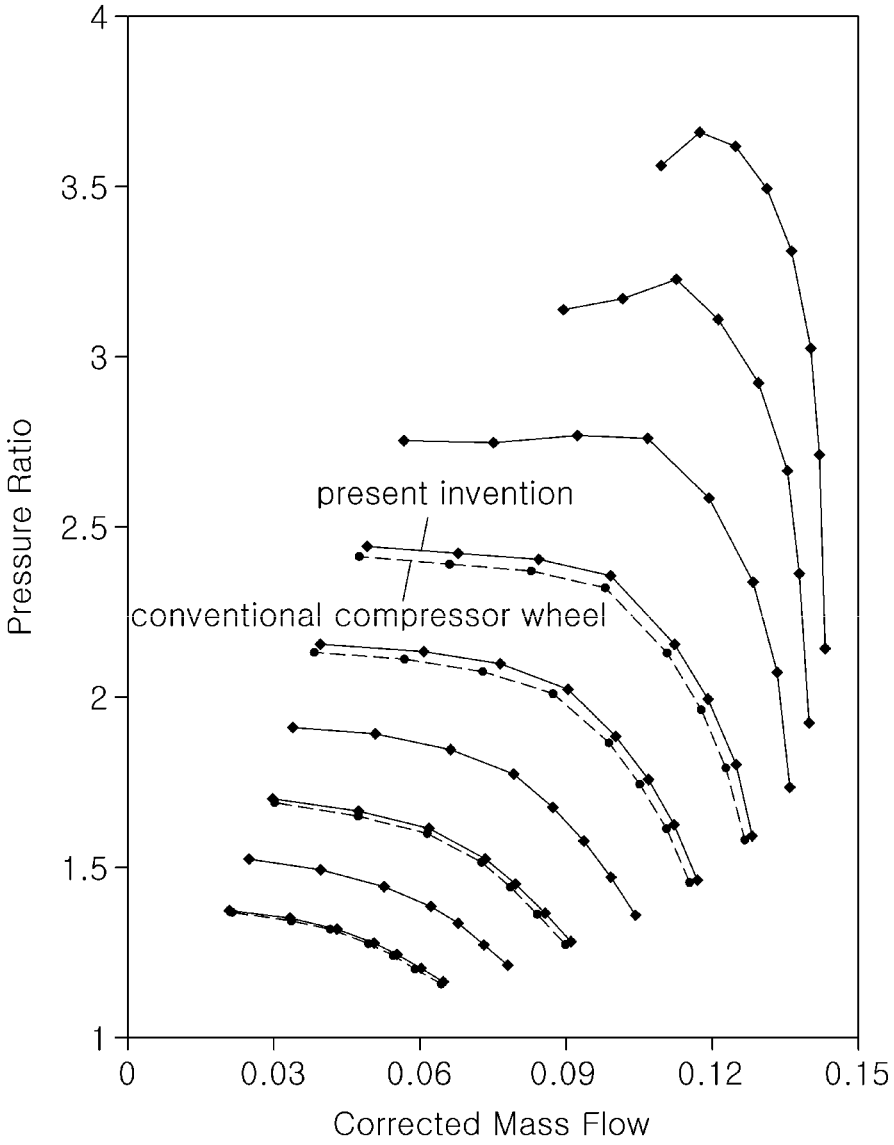
FIG. 7 is a graph of comparing a pressure ratios of the turbocharger using the compressor wheel of the present disclosure with the turbocharger using the conventional compressor wheel, and a graph of a pressure ratio depending on flow.
Figure 8:
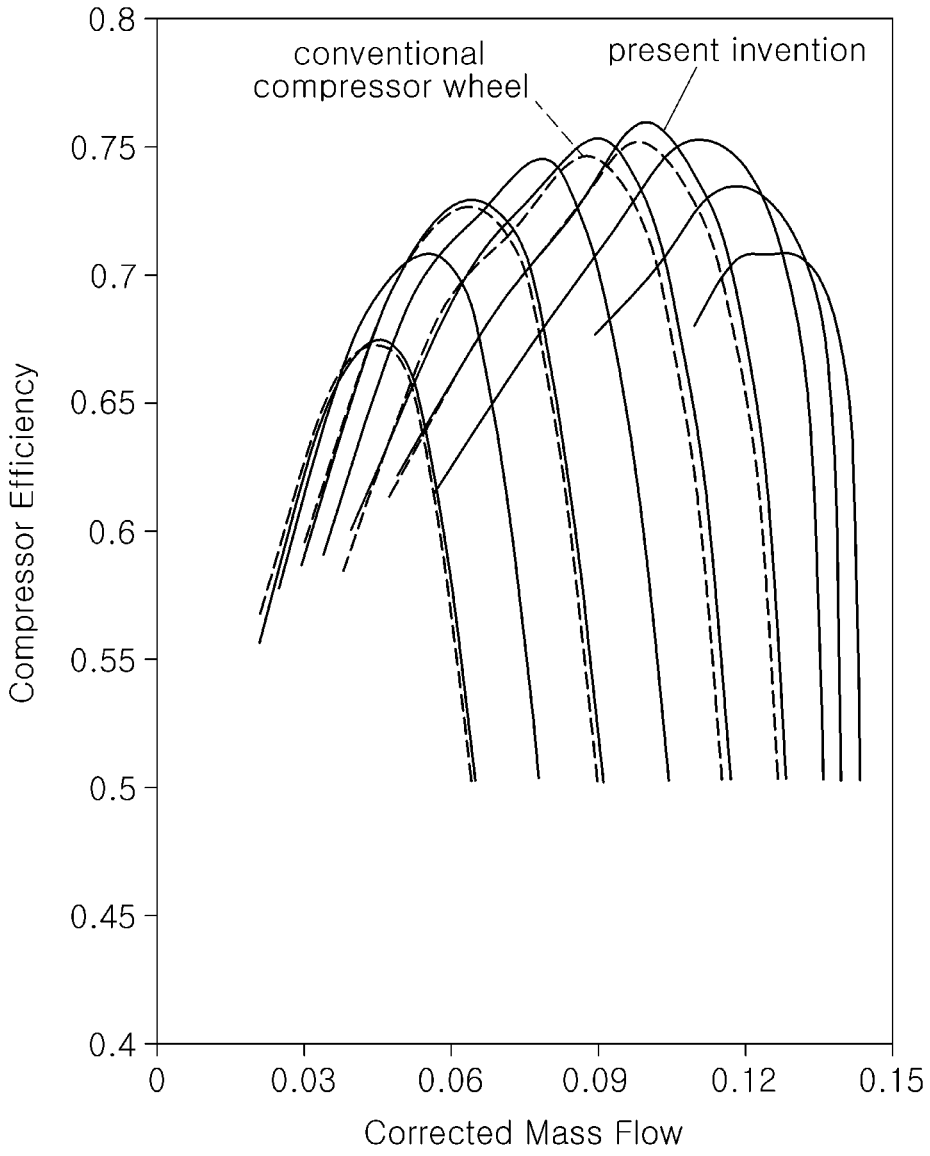
FIG. 8 is a graph of comparing the efficiency in the turbocharger using the compressor wheel of the present disclosure with in the turbocharger using the conventional compressor wheel, and a graph of the compressor efficiency depending on flow.

FIG. 7 is a graph of comparing the pressure ratios of the turbocharger using the compressor wheel of the present disclosure with the turbocharger using the conventional compressor wheel, and a graph of the pressure ratio depending on flow. FIG. 8 is a graph of comparing the efficiency in the turbocharger using the compressor wheel of the present disclosure with in the turbocharger using the conventional compressor wheel, and a graph of the compressor efficiency depending on flow. FIGS. 7 and 8 show that the efficiency of the present disclosure is excellent, and the present disclosure adopts the compressor wheel in which the round projected area with respect to the inlet projected area is 20%.

Figure 9:
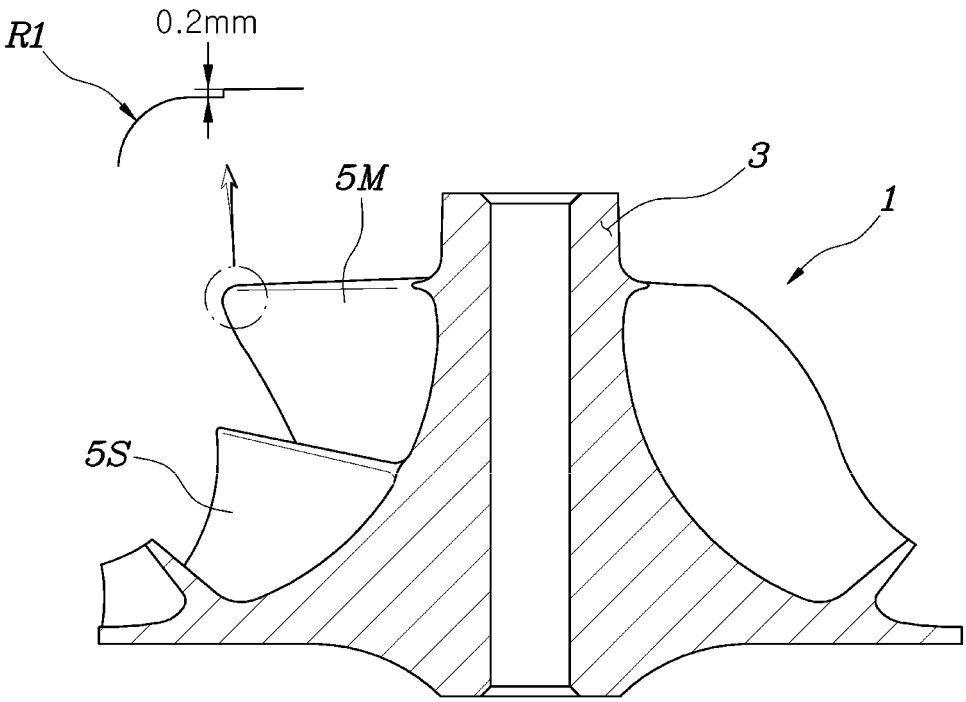
FIG. 9 is a vertical-sectional view showing leading edge cutting of the compressor wheel according to the present disclosure.

Meanwhile, referring to FIG. 9, the leading edge of the blade may be cut within 30% of overall length of the leading edge from the leading edge tip, and within a predetermined reference length.

That is, by presenting a limit to allow cutting of the leading edge that is generated when the round portion 7 is processed on the leading edge tip of the blade, mass production of the compressor wheel can be ensured.

For example, when a radius of the round portion is about 1 mm to 2 mm, the reference length may be set to about 0.2 mm, and when the leading edge of the blade is about 10 mm, the cut length may be approximately 3 mm.

Although a preferred embodiment of the present disclosure has been described for illustrative purposes, those skilled in the art will appreciate that various modifications, additions and substitutions are possible, without departing from the scope and spirit of the disclosure as disclosed in the accompanying claims.

What is claimed is:

1. A compressor wheel for a turbocharger, the compressor wheel comprising:

a wheel hub; and a plurality of blades provided around the wheel hub in a spiral shape, wherein when the plurality of blades is arranged such that relatively large main blades and relatively small sub blades are alternately arranged around the wheel hub, a round portion is provided only in a tip of a leading edge of each of the relatively large main blades.

2. The compressor wheel of claim 1, wherein the round portion is configured such that a round projected area that is an area of a round projected length sweeping away on a projection plane by one rotation is within a range of 15% to 20% of an effective inlet area that is an area of the leading edge of each of the plurality of blades sweeping away on the projection plane by said one rotation, the round projected length being a radial length of the compressor wheel that is obtained by projecting the round portion on the projection plane perpendicular to a rotation shaft of the compressor wheel.

3. The compressor wheel of claim 2, wherein the round projected length is determined by an equation:

$$\sqrt{R^2-0.15(R^2-R_H^2)} \leq \overline{R} \leq \sqrt{R^2-0.2(R^2-R_H^2)},$$

wherein $\overline{R}$ is the round projected length,

R is a maximum radius at an inlet side of the compressor wheel, and $R_H$ is a radius of the wheel hub.

4. The compressor wheel of claim 2, wherein the leading edge of each of the plurality of blades is cut within 30% of an overall length of the leading edge from the tip of the leading edge and within a predetermined reference length.

5. The compressor wheel of claim 4, wherein the predetermined reference length is 0.2 mm.

* * * * *